United States Patent [19]

Saadi et al.

[11] 4,383,912

[45] May 17, 1983

[54] PROCESSES OF PYROLYSIS AND TREATMENT OF PYROLYSIS RESIDUES

[75] Inventors: Moussa Saadi, Rabat-Agdal; Rabah Bouchta, Rabat, both of Morocco; Chang Y. Cha, Golden, Colo.; Mohamed Sdiqui, Rabat; Bachir Barodi, Rabat-Souissi, both of Morocco

[73] Assignee: Bureau de Recherches et de Participations Minieres, Rabat, Morocco

[21] Appl. No.: 269,675

[22] Filed: Jun. 2, 1981

[30] Foreign Application Priority Data

Jun. 2, 1980 [MA] Morocco ..... 19064

[51] Int. Cl.[3] ..... C10G 1/00; C10B 53/06

[52] U.S. Cl. ..... 208/11 R; 208/8 R; 201/34

[58] Field of Search ..... 208/8 R, 11 R; 201/14, 201/34, 38, 39

[56] References Cited

U.S. PATENT DOCUMENTS 1,469,628 10/1923 Dundas et al. .

1,536,696 5/1925 Wallace .

3,661,423 5/1972 Garret ..... 299/2

3,994,343 11/1976 Cha et al. ..... 208/11 R X 4,126,180 11/1978 Cha ..... 208/11 R X

*Primary Examiner*—Delbert E. Gantz

*Assistant Examiner*—Glenn A. Caldarola

*Attorney, Agent, or Firm*—Fleit, Jacobson & Cohn

[57] ABSTRACT

The invention pertains to a process of pyrolysis of shale capable of producing hydrocarbons. It comprises associating at least two retorts and causing their respective operational phases to be so coordinated as to achieve simultaneous pyrolysis of said materials in one of said retorts and treatment of the hot residues subsequent to an earlier pyrolysis in another of said retorts, said treatment comprising the discharging of the residues, the admission or supply into said other retort of crude or raw material as well as the recovery of the heat contained in the pyrolysis residues by means of a circulation therethrough of an oxidant gas, preferably air, and of initially pulverized or atomized water, the resulting mixture of oxidant gas and steam being then supplied into a retort in which a phase of pyrolysis is being run to assist the combustion of the carbonaceous residues formed as a result of the pyrolysis of the load of materials treated or pyrolyzed therein.

When said pyrolysis in one of said retorts and the treatment of the residue in said other retort are both completed the modes of operation of said two retorts are alternated.

13 Claims, 1 Drawing Figure

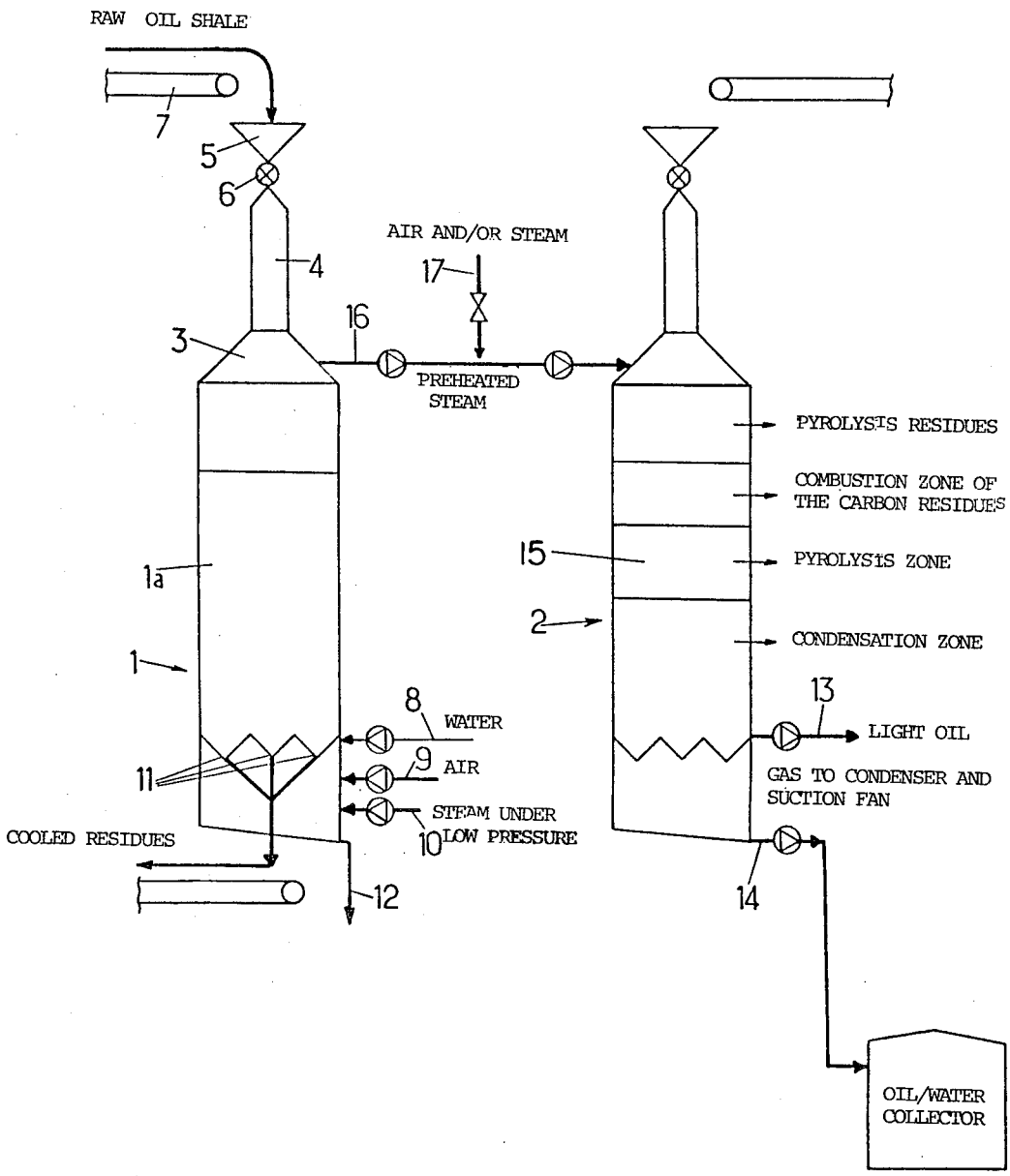
RAW OIL SHALE
7
5
6
4
3
AIR AND/OR STEAM
17
16
PREHEATED STEAM
PYROLYSIS RESIDUES
COMBUSTION ZONE OF THE CARBON RESIDUES
15
PYROLYSIS ZONE
1a
2
CONDENSATION ZONE
1
8
WATER
13
LIGHT OIL
11
9
AIR
GAS TO CONDENSER AND SUCTION FAN
STEAM UNDER LOW PRESSURE
10
COOLED RESIDUES
12
14
OIL/WATER COLLECTOR

PROCESSES OF PYROLYSIS AND TREATMENT OF PYROLYSIS RESIDUES

The invention relates to improvements in processes for the pyrolysis and treatment of pyrolysis residues.

It relates more particularly to a process for the pyrolysis of materials liable of producing liquid or gaseous hydrocarbons by thermal decomposition, and to the treatment of the residues obtained by such process.

In a general manner the materials subjected to that kind of process contain organic material in the form of the so-called "kerogen", tar, bitumen or asphalt, and are formed among others of shale, bituminous or asphaltic rocks, coal, lignite or brown coal, or analogous minerals.

Their pyrolysis provides hydrocarbons, water and carbonaceous residues.

The combustion of the carbonaceous residues is of current use for supplying the heat which is required for pyrolysis. That is for instance the case in the so-called NTU process (NEVADA-TEXAS-UTAH) disclosed in U.S. Pat. No. 1,469,628, wherein the internal combustion of the carbonaceous residues is performed by means of air injection at the top of the pyrolysis furnace or retort.

For instance a process has been disclosed in U.S. Pat. No. 1,536,696 for the sake of upkeeping the combustion of these residues, which process comprises injecting in the pyrolysis retort a mixture of air and back-cycled (or recycled) gases.

Yet the general carrying into practice of these processes has run into various difficulties. Particularly it has been found that the pyrolysis is incomplete in the lower part of the retort and that, as a general rule, the pyrolysis develops in an unsatisfactory manner, among others with the attendant undesirable formation of charcoal in the ducts or lines in which the gases are caused to circulate, as well an an incomplete condensation of oils as a consequence of the high temperature of the gases removed from the retort.

Moreover the discontinuous character of these processes is particularly uneconomical. As a matter of fact the hot residues must be removed at the end of the pyrolysis and cooled. The retort must then be loaded again prior to initiating a new pyrolysis, whence a reduction of the time of operation of the retort, accordingly of the oil-production yield.

Furthermore, the treatment of these hot bodies of residues entails major difficulties and operational risks. They are cumbersome and the dust produced add many difficulties when the conventional processes are run.

In an attempt to find means capable of overcoming at least in part the drawbacks that accompany processes of the prior art and to run the pyrolysis in half-continuous or semi-continuous manner, the inventors focussed on the hot residues as obtained at the end of a cycle of pyrolysis. It has been found that by subjecting these residues to specific treatments, it was possible not only to take advantage of the thermal energy they contain to have it contribute to pyrolysis in other retorts, but also to prepare the retort itself in which said residues are treated to be ready for a subsequent pyrolysis operation.

Accordingly an object of the invention is to provide a process for the treatment of materials of the type concerned that can be run semi-continuously, thus to make it more economical.

Another object of the invention is to provide a process that can achieve more easely the treatment and removal of the pyrolysis residues and the preparation of the retorts for a next pyrolysis operation.

Still another object of the invention is to provide a process that enables the heat of the residues to contribute to other pyrolysis operations.

The process according to the invention comprises associating at least two retorts and causing their respective operational phases to be so coordinated as to achieve simultaneous pyrolysis of said materials in one of said retorts and treatment of the hot residue subsequent to an earlier pyrolysis in another of said retorts, said treatment comprising the discharging of the residues, the admission or supply into said other retort of crude or raw material as well as the recovery of the heat contained in the pyrolysis residues by means of a circulation therethrough of an oxidant gas, preferably air, and of initially pulverised or atomized water, the resulting mixture of oxidant gas and steam being then supplied into a retort in which a phase of pyrolysis is being run to assist the combustion of the carbonaceous residue formed as a result of the pyrolysis of the load of materials treated or pyrolysed therein.

These provisions enable accordingly the preparation of a retort in order to have it be ready for a new phase of pyrolysis, while at the same time treating pyrolysis residues and recovering of the heat contained therein, said recovered heat being then made available to assist a pyrolysis operation in another retort.

The alternate operations that comprise, on the one hand, the treatment of the pyrolysis residues, including the discharging of residues from and supply of a new load of crude or raw material into a retort and, on the other hand, the pyrolysis operations in another retort, thus permit a semicontinuous operation of an installation including these different retorts to be achieved.

As a matter of fact the only idle time corresponds to that required for initiating the combustion at the beginning of the pyrolysis in the corresponding retort. Of course, the greater the number of retorts operated, the less significant the idle times. The invention thus achieves a significant increase of the time under which the retorts are operative, hence the yield of oil produced.

Moreover the procedure of treatment according to the invention of the pyrolysis residues exhibits at least a two-fold advantage.

First the residues are treated in that retort in which they were subjected to pyrolysis beforehand and are progressively removed, yet only after they have been cooled. This provides for the overcoming of the difficulties entailed previously by dischargement of the still hot residues in bulk. Second, the invention provides means which enable not only the cooling of the residues before dischargement to be achieved, but also their heat-content to be recovered and to be made available in another retort to assist and improve the pyrolysis operation then under way therein.

It will furthermore be appreciated that the flow of hot air and steam through the shale body while the latter is admitted into the retort provides for an advantageous preheating thereof, and for a reduction of the time—and energy—outputs in the subsequent pyrolysis phase of the shale.

In addition, the invention enables retorts substantially similar in construction to be used, particularly conventional pyrolysis-retorts which will be alternatively operated according to a pyrolysis phase and a treatment phase of the pyrolysis residues, including the supply of crude material and dischargement of the cooled residues.

According to a further advantageous feature of the invention, at least part of the water formed during the pyrolysis phase of a load of material is back-cycled or recycled to a retort operating according to the residue-treatment phase, to thereby again produce and supply again steam that will contribute to the combustion of the carbonaceous residues in a pyrolysis phase in another retort. Noteworthy is the advantageous fact that this pyrolysis water requires no preliminary treatment preparatory to its admission into a retort in which a treatment of residues is under way.

It has been found that, generally, the polluting organic compounds contained in said water are subject to cracking, accordingly destroyed, when brought into contact with the hot residues.

In accordance with another provision of the invention, the discharging of the cooled residues is so adjusted as to leave a layer of residues in the bottom part of the corresponding retort, thereby overcoming most of the problems consequent to the high temperatures of the gases removed in the processes of the prior art.

As a matter of fact this layer of residues has proven to be useful in that it causes decrease in temperature of the removed gases and avoids oil cooking and, accordingly, the formation of charcoal deposits in the gas-ducts or lines, as well as an incomplete condensation of oils. This also enables a complete pyrolysis of a load of crude material to be achieved, yet without endangering the retort bottom.

DESCRIPTION OF DRAWINGS

Other features and advantages of the invention will further appear from the following disclosure and drawing which show a group of two retorts in which a treatment operation of residues on the one hand, and pyrolysis operation on the other hand, are run alternatively.

The two retorts 1 and 2 of the installation shown in the drawing are similar in construction.

Each of these retorts consists broadly of vertical cylindrical elements of steel iron or analogous material ending in its upper part into an inwardly directed frusto-conical shape 3 the latter being itself prolonged at its upper end by a vertical tubular element 4. A hopper 5 is provided at its top, and connected therewith through equipment means 6 for the adjustment of the rate of admission of material into the retort. The material is supplied through line 7.

Retort 1 contains a load or body of residues (1*a*) of a pyrolysis and combustion.

Three lines 8, 9 and 10, provided with valve means, for the supply respectively of atomized water or water spray, air and steam under low pressure, lead into the lower part of retort 1. The latter includes discharging means including a discharging line 11 for the pyrolysed residues, as well as a line 12 for the water which has not be driven up through retort 1 towards retort 2.

Retort 2 contains a load of bituminous shale 15 to be subjected to pyrolysis.

Retorts 1 and 2 communicate, particularly in their upper parts, through a valve-controlled line 16. A valve-controlled line 17 for the supply of air and/or steam opens into line 16.

The operation of retorts 1 and 2 is so coordinated as to achieve a treatment of hot residues 1*a* (including cooling of these residues, discharging the cooled residues and supplying a new load of crude shale) in retort 1, and a pyrolysis of the shale mass 15 in retort 2 simultaneously.

The coordination of the respective operations of each of the retort brings into play the control of different parameters, such as the flows of air and of atomized water, the temperature, in order to avoid pyrolysis of the newly admitted crude material, as well as the supplying and discharging rates, the rates of displacement of the cooling zone or front in one of the retorts and of the combustion zone or front in the other retort.

The adjustment of these different parameters is obviously within the abilities of the man skilled in the art, and shall also depend on the nature and amounts of the materials to be treated.

At the operation outset, retort 1 contains a mass of hot residues, as obtained at the end of a pyrolysis operation.

Air and water in spray form are uniformly injected, in continuous manner, through lines 8 and 9. The inlets of these lines are located in the bottom part of the retort. Generally the location of the line inlets is dependant on the supplying or loading equipment used.

At the contact of the residue hot body, the air is heated and the water transformed into steam while the bottom part of the body of residue is cooled. The mixture of hot air and steam flows upward through the material, is then released through line 16 and admitted into retort 2 in which a pyrolysis operation has been initiated.

The water droplet sizes in the spray must be small enough in order to be driven through the body of the residues to be cooled.

At the beginning of the cooling operation of the residues, steam under low pressure is injected too through line 11 in order to help remove or sweep the gaseous hydrocarbons possibly still present in the body of pyrolyzed residues. Any explosion risk owing to the air also admitted into retort 1 is thereby avoided too.

According to an advantageous result of the invention, the steam circulating through the body of residues is liable of reacting with carbon possibly present in these residues to form carbon monoxide and hydrogen, which form an advantageous auxiliary fuel which can be delivered into retort 2, the latter then being in the initiation stage of the pyrolysis operation, while the cooling of body 1*a* is started in retort 1.

The flow rates of air, atomized water and, wherever needed, steam under low pressure, are adjusted under conditions providing for the best possible contacts within the body in order to recover its heat content.

According to a preferred embodiment of the invention, suitable conditions appear met when the total flow rate of air and water injected admitted or injected into retort 2, through line 16, ranges from about 1 to about 5 $m^3/min./m^2$ of retort cross-section, and preferably is about 2.5 $m^3/min./m^2$ The proportion of water in the injected mixture ranges advantageously from about 10 to about 80% in volume, preferably is of about 50%.

This provides conditions suitable for the running of a pyrolysis operation in retort 2. An additional supply of air and/or of steam from an external source can be achieved if required, through line 17.

The water which is not driven upwards by the upflowing air is removed through line 12 and cycled back into the process.

The discharging of the pyrolysis residues is carried out through the line assembly 11, which may consist of any suitable conventional equipment.

This discharging may be carried out by any suitable means, either in continuous manner or stepwise, at regular intervals, the discharging rate being controlled in accordance with the coordination established with the other operational phases that are being run within the installation. Preferably, a bottom layer of pyrolysis residue of sufficient height will be retained in retort 1, at the end of discharging operation, in order to provide for the protection of the discharging means of device, when the combustion front will reach the corresponding zone, at the end of the pyrolysis operation to be carried out subsequently in that a retort. As already indicated, this layer participates into avoiding, at least to a large extent, the problems run into previously that were associated with the high temperatures of the gases which were released from the retorts in the conventional processes.

The equipment of retort 1 also includes load or supply means of crude raw oil shale. This supply may be carried out continuously, or step wise, at regular intervals, in accordance with the discharging steps, or immediately thereafter or also at a time between two successive partial discharging steps. There again the supply conditions are adjusted so as to enable appropriate coordination of the different operations which are being run within the whole installation.

It is preferred, in order to increase the pyrolysis oil yield, to provide for the loading of the raw material according to appropriate distribution of particle size intervals. The latter are preferably such that, once the loading of the retort has been completed, successive layers be obtained, whereby the size intervals of the particles in any of said layers are kept relatively small, particularly to thereby reduce oil losses, avoid phenomena caused by preferential flow paths for the gases that may otherwise be created within the body of material and pressure drops within the retort.

The size interval in the upper layer is chosen more particularly dependent on an easy initiation of the combustion of the shale at the beginning of the pyrolysis operation.

In that respect, a $\delta$-particle-size interval, in millimeters, ranging from zero to about 13 mm. ($0<\delta<13$ mm) preferably from about 4 to about 8 mm has found to be advantageous.

In a preferred embodiment of the invention the supply of raw material is carried out in order to form four successive layers a, b, c and d having respective size ranges (in mm) respectively from about 0 to about 13 for a, from about 75 to about 150 for b, from about 13 to about 75 for c and from about 75 to 150 for d.

The particle size interval of the cooled residue left in the lower part of the retort as a protection layer ranges advantageously from about 80 to about 150 mm.

The respective proportions of these different layers are adjusted so as to achieve the most suitable development of the pyrolysis process.

Advantageously the loading is carried out so that layer a will represent from about 1 to about 3%, preferably about 2% of the total load volume, layer b from about 3 to about 5%, preferably about 4%, layer c from about 45 to about 50%, preferably about 48%, layer d from about 40 to about 45%, preferably about 42%, the volume of the cooled residue remaining in the lower position of the retort 1 representing from about 3 to about 5%, preferably 4% (percentages are volume % with respect to the volume of the wholeload).

While all the above-mentioned operations are carried out in retort 1, a load 15 of bituminous or oil shale is pyrolysed in retort 2. This load is advantageously formed of the abovesaid layers a, b, c and d having the above-mentioned size intervals.

The pyrolysis is achieved according to the so-called internal combustion process, which comprises supplying the heat required by the shale decomposition by the combustion of the carbonaceous residues resulting from said pyrolysis.

Fuel, gas or shale oil is used in order to initiate said pyrolysis.

The combustion zone is caused to move downwards.

One may diagrammatically distinguish as the pyrolysis proceeds, first a zone consisting of pyrolysis residues or ashes, then a combustion zone of the carbonaceous residues which moves downwards towards the bottom of the retort, then a pyrolysis zone which moves downwards too and a body of raw material which will be reached first by the pyrolysis front, then by the combustion front.

The pyrolysis conditions are controlled such as to enable the desired decomposition of the shale to provide liquid, vaporized and gaseous hydrocarbons. The liquid hydrocarbons are removed through a line 14 provided in the lower part of retort 2. The light oils, in the form of vapors or gas are removed through a line 13 and delivered to a condenser and a suction fan which are not represented. Water is formed too during pyrolysis and is also removed through line 14. According to an advantageous embodiment of the invention, part at least if not all of the pyrolysis water is recycled back to retort 1, without undergoing any preliminary treatment.

The water and liquid oils are then transferred through line 14 to an oil and water collector, and the gases are delivered to condensation and treatment equipment.

The combustion of the carbonaceous residue is maintained owing to the injection of hot air and stream which is advantageously delivered from retort 1.

The use of steam in the pyrolysis operation is of advantage, in that it prevents strong temperature increases. Further the reaction stream with the carbonaceous residues provides for a rapid displacement of the combustion front. The production of hydrogen is increased as a result of reaction of said steam with carbon monoxide. Generally the use of steam results in the reduction of the oil losses caused by thermal cracking.

The retorts may be operated according to the invention under either positive or negative pressure.

The retorts may be constructed on the ground surface or under ground surface. They may exhibit any general shape suitable for the performance of the above-described process steps.

For the sake of illustrating the invention, yet without limiting it thereby, an example is described hereafter of a preferred processed embodiment in an installation of the type diagrammatically shown on the drawing.

The parts of general cylindrical shape of the retorts 1 and 2 have a 30 m height and a 12 m diameter.

Retort 1 contains about 4500 tons of hot residues such as obtained at the end of a pyrolysis operation that had been run on a 5000 ton-load of oil-shale, containing 70 liters of hydrocarbon as determined with respect to the Fisher test of shale and a caloric value above 950 kilocalories/kg.

The operating conditions of each of the retorts are adjusted so as to enable the cooling of the body of hot residue to take place in retort 1 over a five day period, while at the same time the pyrolysis of the load of initially raw shale so as to be carried out over 4–5 days.

The cooling of the hot residues is carried out by means of 52 kg/minute of water injected through line 8. 142 $m^3$/minute of air is injected through line 9. The gas and stream circulation through the body of residues in retort 1 is ensured by means of suction devices not shown and connected to retort 2.

The circulation conditions are adjusted such as to obtain a total flow-rate of air and steam in line 16, at the admission inlet into retort 2, of 210 $m^3$/minute. If need be up to 74 $m^3$/minute of steam are injected through line 17.

A new supply of raw shale is charged into the apparatus and cooled residues are discharged out simultaneously at four hour intervals, over 30 minute periods. 150 tons of cooled residue are each time removed from the lower part while at the same time 150 tons of raw shale are delivered into the upper part of retort 1. The discharging operations are stopped when the volume of cooled residue will have been reduced to approximately 4% in volume of the whole volume of the material then contained in retort 1. The particle size of these residues range from about 76 to about 152 min.

The loading operation is carried out so as to provide, from the bottom to the upper part, first a layer of shale having particle sizes ranging from 76 to 152 mm. and representing 42% of the total volume, then above the first layer, a second layer having particle sizes ranging from 12 to 16 mm. and representing 48% of the total volume, then a layer with particle sizes ranging from 76 to 152 mm. and representing 4% in volume, and finally a layer having particle sizes of 13 mm or less and representing 2% of the total volume.

The pyrolysis in retort 2 is carried out on a load of shale exhibiting initially the distribution in volume percentages and particle sizes as above described hereabove in relation to the loading of retort 1.

After two days and a half of operation of the installation, under supply of air and steam at a flow-rate of 2.5 $m^3$/minute/$m^2$ of cross section in retort 2, the combustion front 2 is approximately in the middle part of retort 2, the separation zone between the raw shale and the residue in the middle part of retort 1.

The average temperature of the shale in retort 1 is then of about 90° C., the maximum temperature in the hottest parts of the residue is of 500° C. and the average temperature in the bottom part of the retort of 65° C.

In retort 2, the average temperature of the residue is of 250° C., the maximum temperature of the combustion front of 900° C., the average temperature of the pyrolysis zone of 450° C., the average temperature in the zone of condensation of 90° C. and the average temperature of the residues in the lower part of the retort of 65° C. At the end of the pyrolysis phase a yield in hydrocarbons as expressed with respect to the Fisher test is of approximately 85%. When hydrolysis of the shale and combustion of the carbonaceous residue has been completed in retort 2 as disclosed hereabove, on the one hand, and when at the end of the treatment procedure ending in the loading of retort 1 with the new shale to be pyrolyzed has been completed, the operation characteristics of the two retorts are then switched over in order to initiate pyrolysis of the new load in retort 1 and in a coordinated manner the cooling operation of the hot pyrolysis and combustion residues in retort 2 are then initiated too.

Needless say that the two (or more) retorts of the installation are both equipped with the different assay standard equipment which has been disclosed hereabove with respect to retort 1 and retort 2 respectively.

While in the preceding example the process has been disclosed as applied in a couple of retorts that can be operated in an alternate manner according to the two modes of operation which have been disclosed herebefore, it will obviously be appreciated that when a greater number of retorts are used they can be connected in different manners in order to perform the abovesaid mode of operation in coordinate manner. Particularly they could be connected in series and operate alternatively, according for instance to the following scheme: when the first one operates a pyrolysis of a load of shale, the water from the pyrolysis may be recovered at least in part, and after atomization, be supplied for the cooling operation of the residues in the second retort which would have been operated according to the pyrolysis mode beforehand; the mixture of hot air and steam recovered from the second retort of the series then being supplied to the third retort of the series then operating according to the pyrolysis mode to contribute to the combustion of the carbonaceous shale residue required for pyrolysis, etc. It will appear obvious to the man skilled in the art that the alternation of modes of operation of the retorts in those series can be achieved in coordinate manner.

We claim:

1. A process of pyrolyzing solid materials capable of producing liquid and gaseous hydrocarbons comprising arranging at least two retorts, pyrolyzing said materials in a first one of said at least two retorts, simultaneously treating hot residues from an earlier pyrolysis in a second one of said at least two retorts, said treatment comprising introducing an oxidant gas and atomized water into said second retort, causing said oxidant gas and said water to circulate through said hot residues contained in said second retort, supplying the resulting mixture of oxidant gas and steam to said first retort or into another of said at least two retorts in which a pyrolysis operation is being carried out, discharging cooled residues from said second retort and supplying raw materials capable of producing liquid and gaseous hydrocarbons when pyrolyzed to said second retort and when said pyrolysis in said first retort and said treatment of said residues in said second retort are completed, the mode of operations in said first and second retorts is alternated, if it is desired, to carry out a semi-continuous process.

2. The process of claim 1 in which water formed during the course of said pyrolysis of said materials is recycled to the retort in which said residues are being subjected to said treatment.

3. The process of claim 1 in which the total flow rate of said oxidant gas and said atomized water supplied to said second retort in which the treatment of said residues is taking place ranges from 1 to 5 $m^3$/min./$m^2$ of cross-section.

4. The process of claim 3 in which said total flow rate of said oxidant gas and said atomized water is about 2.5 $m^3$/min./$m^2$.

5. The process of claim 3 in which said mixture of oxidant gas and atomized water contains about 10 to about 80% by volume of water.

6. The process of claim 1 in which said mixture contains about 50% by volume of water.

7. The process of claim 1 in which the cooled residues are discharged continuously.

8. The process of claim 1 in which the cooled residues are discharged step-wise at regular intervals.

9. The process of claim 1 in which a layer of cooled residues is left in the bottom of said second retort at the end of said treatment operation.

10. The method of claims 1, 2, 3, 7, 8, or 9 in which said solid materials capable of producing liquid and gaseous hydrocarbons consist of materials containing organic material as kerogen, asphalt, lignite, coal, shale containing oil, or bitumin.

11. The process of claim 1 in which said raw materials are supplied to said second retort continuously or step-wise during said discharging of said cooled residues, or immediately thereafter, or during two steps of discharging said cooled residues.

12. The process of claim 1 in which said raw materials are charged as successive layers having a low difference of granulometery with respect to a predetermined section of the retort.

13. The process of claim 1 in which hydrogen and carbon monoxide produced by reaction of steam with carbon of said pyrolysis residues are used as additional fuel for starting combustion of said materials in said first retort.

* * * * *